US005868372A

United States Patent [19]

Novak et al.

[11] Patent Number: 5,868,372

[45] Date of Patent: Feb. 9, 1999

[54] FURNITURE FOOT

[76] Inventors: Berkley G. Novak, Rte. 1, Box 232H, Moneta, Va. 24121; Neil E. Novak, Rte. 7 Box 74B, Lynchburg, Va. 24503

[21] Appl. No.: 959,506

[22] Filed: Oct. 28, 1997

[51] Int. Cl.[6] ..... A47B 91/00

[52] U.S. Cl. ..... 248/346.11; 248/345.1

[58] Field of Search ..... 248/205.3, 188.9, 248/345.1, 677, 188.1, 346.11

[56] References Cited

U.S. PATENT DOCUMENTS

| | | | |
|---|---|---|---|
| 763,306 | 6/1904 | Miller | 248/188.9 |
| 1,726,121 | 8/1929 | Polkosnik . | |
| 2,540,296 | 2/1951 | Schwend et al. | 248/188.9 X |
| 2,875,552 | 3/1959 | Stillman | 248/188.9 |
| 2,886,918 | 5/1959 | Bayley et al. . | |
| 2,995,863 | 8/1961 | Bright | 248/345.1 |
| 3,108,393 | 10/1963 | Baker . | |
| 4,190,001 | 2/1980 | Cecala | 248/188.9 X |
| 5,322,257 | 6/1994 | Verderose et al. | 248/205.3 X |

*Primary Examiner*—Ramon O. Ramirez
*Attorney, Agent, or Firm*—Woods, Roger & Hazlegwove, PLC; C. Fred Rosenbaum

[57] ABSTRACT

A separator or foot to be inserted between the flat base of a piece of furniture, such as a credenza, file cabinet or china closet, and the supporting floor. The plastic foot is shaped to fit about the corners of the furniture and has a nonuniform bottom surface. The nonuniform surface allows air circulation between the furniture and the floor to prevent formation of deposits, stains and distortion of the of the flooring surface.

4 Claims, 1 Drawing Sheet

FURNITURE FOOT

BACKGROUND OF THE INVENTION

In most commercial buildings and in some homes there are many offices or work areas which have one or more heavy pieces of furniture which rest directly on the floor without benefit of legs or rollers. For example, bookcases, credenzas, file cabinets, china closets are quite heavy when filled with paper or various objects. The base of these pieces usually has a flat surface which rests on the floor and is supported thereby.

Most offices and work areas, as well as homes, are subjected to regular cleaning for hygienic and/or safety purposes. During some cleanings, liquids are applied and removed from the floor surface. This is true whether the floor is unfinished or covered by tile or covered by wood or covered by carpet. Some of the applied liquid will seep beneath the edges of the bases of the furniture pieces and the floor. Because the bases of these pieces are flat, the residual liquid is trapped under the piece. Exposure of the furniture to the dampness results in stains and/or rust due to the chemical reaction between the furniture, the floor and the liquids.

The result of this seepage is found when the piece is moved. In some instances, the floor covering may be stuck to the furniture so tightly that it separates from the floor. In less severe cases the floor or floor covering may be permanently stained and/or deformed by the furniture.

SUMMARY OF THE INVENTION

It is an object of this invention to provide a separator or foot for these pieces which will prevent the formation of unsightly blemishes in the flooring where these pieces of furniture have rested. The separator or foot is placed between the floor and the base of the furniture so that stains cannot be directly transferred from the floor or the furniture. The plastic material of the foot is inert to the usual floor care liquids and to the materials of which the furniture and floors is composed to prevent any additional stains.

It is a further object of this invention to provide the foot with a nonuniform lower surface which contacts the floor or floor covering. This nonuniform surface provides for air circulation between the furniture and the floor to promote evaporation and prevent long term contact between the furniture and the cleaning liquids. The nonuniform surface also reduces the surface area of the furniture which is in contact with the floor thereby reducing friction between the two elements. The reduction in friction allows the furniture to be more easily moved without deformation of the floor covering. This is caused, in part, by the shape of the nonuniform design. Another function of the nonuniform surface is to prevent the formation of a, "suction," or adherence between the larger flat area of the furniture base and the floor. The particular shape of the nonuniform surface is important to the extent that the portion of the foot that is in contact with the floor cannot be so minimal that the weight transferred by the foot, itself, deforms the floor or floor covering. Therefore, the foot may be made in several different sizes and configurations depending on the expected weight of the furniture piece and it's contents.

It is a further object of this invention to provide an attachment between the foot and the furniture to aid in the placement of the separator on the piece and to maintain the foot in place during movement of the furniture.

DETAILED DESCRIPTION OF THE INVENTION

Figure 1:
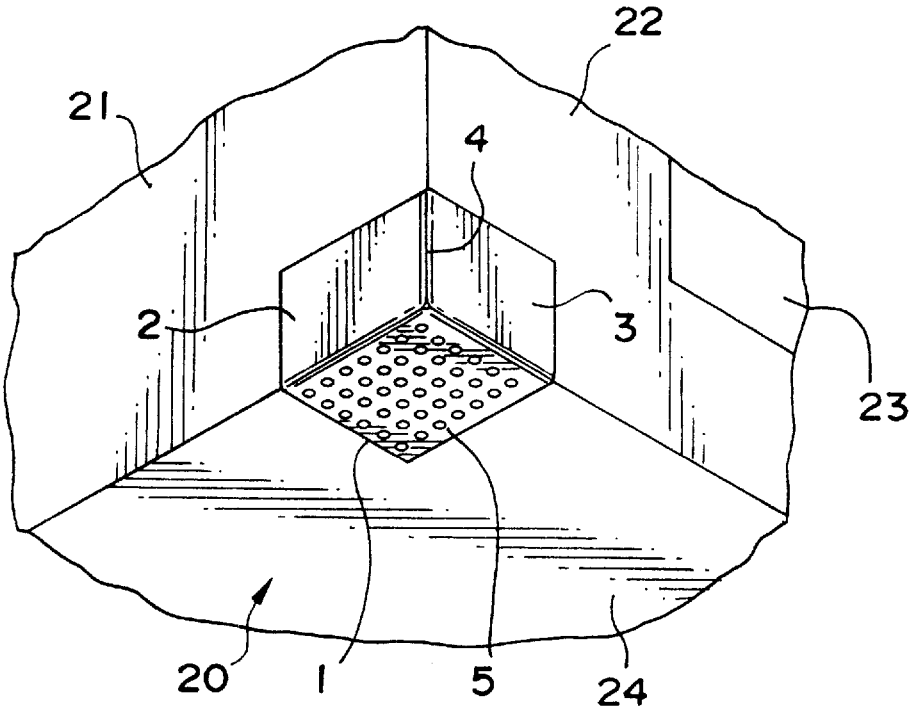
FIG. 1 shows a perspective of the separator as it is used.

In FIG. 1, the separator or foot 10 is shown in perspective mounted on a file cabinet 20. The file cabinet has a long side 21, a front 22, with a drawer 23, and a bottom 24.

In use, the planar base 1 of the foot 10 is disposed between the base of the furniture piece and the floor or floor covering. The periphery of the planar base has upstanding walls 2 and 3. The walls intersect to form the outer corner 4 of the foot 10. The corner 4 serves as a stop limit when the foot is applied to the furniture piece. The planar base 1 is slid under the base of the piece until the corner 4 comes into contact with the piece.

The upstanding walls 2 and 3 may be provided with a pressure sensitive adhesive (not shown) which will hold the foot in contact with the furniture piece. The adhesive may be applied to the foot as a coating. In some instances, the adhesive to be applied to the plastic foot may be different than the adhesive to be applied to the furniture. The adhesive may be in the form of a double faced adhesive tape with the adhesive to be applied to the foot separated from the pressure sensitive adhesive by a carrier material.

The planar base 1 has a nonuniform outer surface 5 which has portions in contact with the flooring and portions not in contact with the flooring. This provides continuous air channels throughout the area of the foot 10. The arrangement of this nonuniform surface can be random, as shown in FIG. 1, or a pattern, as shown in FIG. 2.

Figure 2:
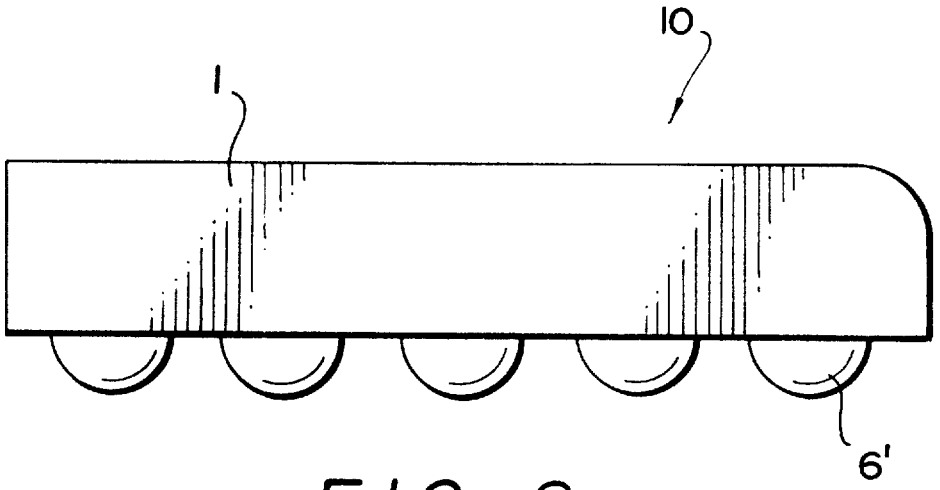
FIG. 2 shows a cross section of the separator and another nonuniform surface.

In FIG. 2, the cross section of the planar base 1 has a pattern of solid hemispherical protrusions 6 formed on the bottom surface. These protuberances are shown disposed in rows however, they could also be arranged in a random dispersion. The contact area between these protuberances and the floor is minimal. The reduction of the amount of surface area in contact with the floor and the ball-shape of the contact points operates to reduce the amount of force necessary to move the furniture across the floor. As an example of this structure, the rows and columns may have hemispheres spaced one-eighth of an inch apart, the height of each hemisphere may be three sixteenths of an inch and the width of the base of the hemisphere may be one quarter of an inch.

The separator or foot may be constructed or molded of any plastic material which has the requisite strength to support the weight of the of the furniture pieces for which it is designed. The material of choice in this device is an ABS polypropylene. The separator may be made in several different sizes for use with different furniture pieces.

While certain novel features of this invention have been shown, described and claimed, it will be understood that various changes in the forms and details of the device illustrated can be made without departing from the spirit of the invention.

We claim:

1. A separator for insertion between heavy objects and the surface upon which said objects are supported, said separator comprising a planar base element oriented parallel to said surface, said planar base element having an outer side for contacting the supporting surface, said outer side including means for reducing friction and allowing air circulation between said outer side and said surface in the form of individual integral protrusions disposed in rows and columns and an inner side for contacting the object, said planar base element having a periphery defined by at least two intersecting angular edges, said base element having raised walls integrally mounted on said intersecting edges, said walls integrally attached to each other at said intersection, said walls and said base element being constructed of a thin, one piece, molded, strong, plastic.

2. A separator of claim 1 wherein said raised walls are coated with a reinforced pressure sensitive adhesive means for adhering said separator to the object.

3. A separator of claim 1 wherein said plastic is an ABS polypropylene polymer.

4. A separator of claim 1 wherein said means for reducing and allowing air circulation comprise hemispherical protrusions.

* * * * *